United States Patent [19]

Swieringa

[11] Patent Number: 4,874,457

[45] Date of Patent: Oct. 17, 1989

[54] WEB CORRUGATING APPARATUS

[75] Inventor: Morris K. Swieringa, Lahaska, Pa.

[73] Assignee: McNeil-PC, Inc., Milltown, N.J.

[21] Appl. No.: 184,516

[22] Filed: Apr. 21, 1988

[51] Int. Cl.[4] ..... B31F 1/34

[52] U.S. Cl. ..... 156/474; 156/208; 156/471; 156/553; 223/28; 264/286; 425/336; 425/343; 425/371; 425/396

[58] Field of Search ..... 156/72, 204, 205, 208, 156/210, 226, 227, 459, 470, 471, 472, 473, 474, 197, 548, 553; 264/286; 425/336, 369, 370, 371, 373, 396, 343, 363, 383; 223/28, 32; 28/279; 226/104

[56] References Cited

U.S. PATENT DOCUMENTS

| | | | |
|---|---|---|---|
| 230,091 | 7/1880 | Walker | 28/279 X |
| 568,307 | 9/1896 | Meisel | 493/422 |
| 1,290,800 | 1/1919 | Teall | 425/371 X |
| 1,903,618 | 4/1933 | Brintnall | 233/28 X |
| 1,989,690 | 2/1935 | Heldenbrand et al. | 28/279 X |
| 2,513,777 | 7/1950 | Andre | 223/28 X |
| 2,525,202 | 10/1950 | Bossi | 156/471 |
| 2,636,250 | 4/1953 | Hemmi | 28/279 |
| 2,831,525 | 4/1958 | Cole | 425/396 X |
| 3,157,551 | 11/1964 | Granozio | 425/371 X |
| 3,227,592 | 1/1966 | Coates et al. | 156/208 X |
| 3,376,178 | 4/1968 | McAlpine | 156/72 |
| 3,723,213 | 3/1973 | Hoey | 28/279 X |
| 3,785,914 | 1/1974 | King | 156/206 X |
| 3,905,857 | 9/1975 | Short | 156/72 X |
| 4,017,247 | 4/1977 | Soukup et al. | 425/373 X |
| 4,241,478 | 12/1980 | Nürk | 28/278 X |

FOREIGN PATENT DOCUMENTS

| | | | |
|---|---|---|---|
| 364381 | 3/1921 | Fed. Rep. of Germany | 264/285 |
| 0903216 | 2/1982 | U.S.S.R. | 156/205 |

*Primary Examiner*—Michael W. Ball
*Assistant Examiner*—David William Herb
*Attorney, Agent, or Firm*—Joseph F. Shirtz

[57] ABSTRACT

An apparatus for corrugating a flexible web containing heat softenable fibers comprising two pairs of endless drive chains with paddles mounted to each pair of chains to extend radially outward therefrom. The web is introduced onto the paddles at a point where the paddles are fanned out by passage of the paddles about the arcuate end of the endless chains. The web is folded between the paddles as the separation between the paddles is closed when the paddles move from the arcuate to the straight portion of the endless chains. Heating means soften and bond fibers of adjacent folds of the web together prior to removal of the corrugated web from the paddles.

14 Claims, 10 Drawing Sheets

20
45
19
17a
18
17
16
15
14b
11
14a
10

FIG-7
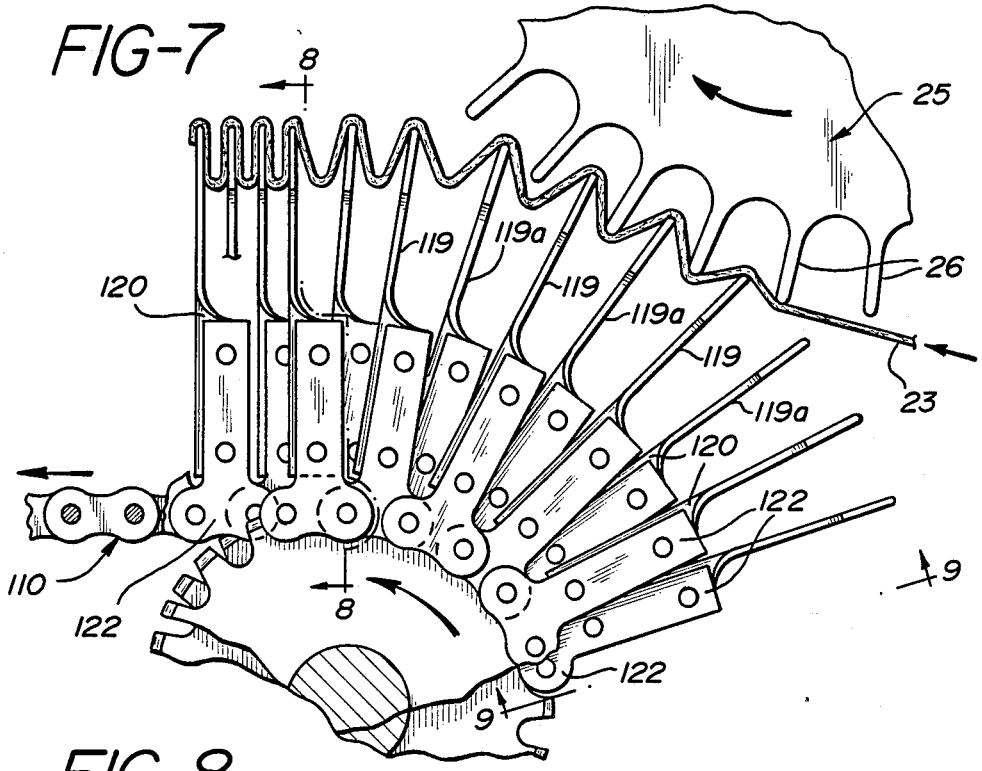
FIG-8
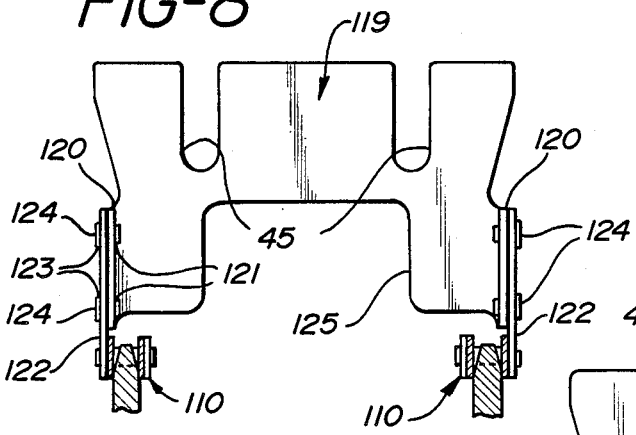
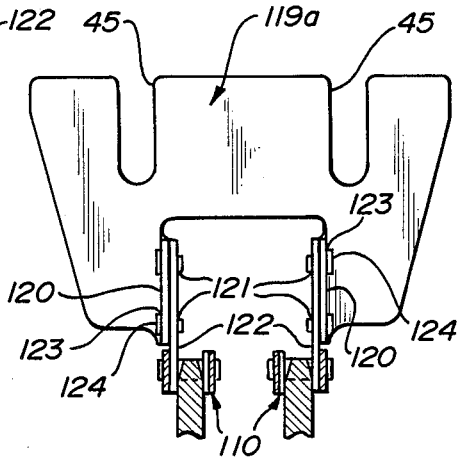
FIG-9

FIG-13
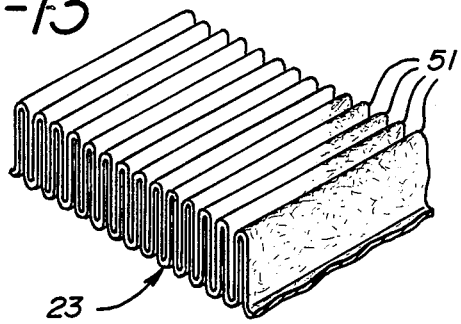
FIG-14
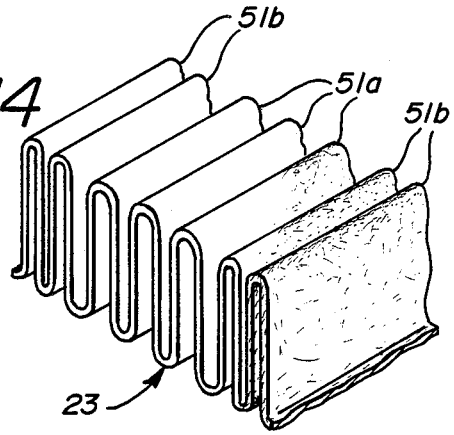
FIG-15
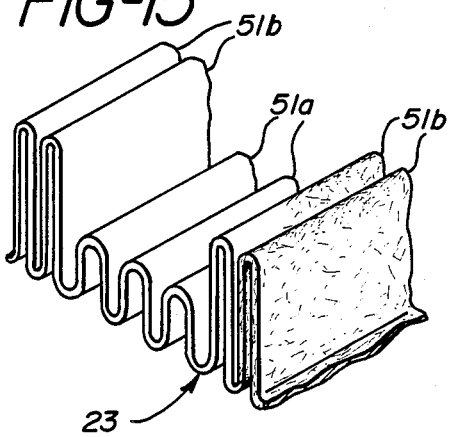
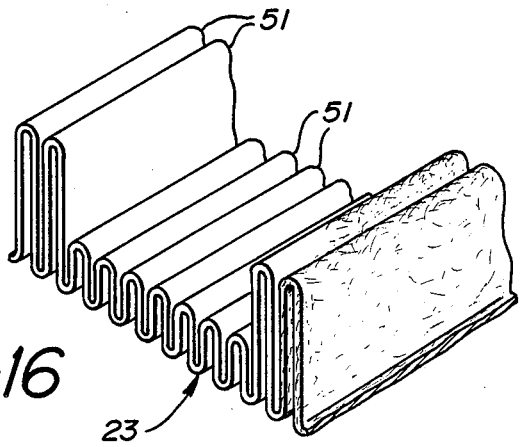
FIG-16

WEB CORRUGATING APPARATUS

FIELD OF THE INVENTION

The invention relates to a method and apparatus for corrugating a flexible web and in particular to a method and apparatus for providing predetermined corrugation patterns at high speeds.

BACKGROUND OF THE INVENTION

Many devices have been developed to provide corrugations or undulations to a web of material. For example, U.S. Pat. No. 2,016,290 shows a pair of intermeshing toothed gears or belts used to form web corrugations in between intermeshing teeth. The web is fed in and bent around the teeth to form wave pattern.

U.S. Pat. No. 2,350,996 discloses an apparatus having a pair of endless chains which carry tooth-like members which interengage along a straight path. The interengaging tooth-like members compress a web between the teeth on one chain and the teeth on the other thus providing a wavy profile to the compressed web.

U.S. Pat. No. 2,303,381 shows a sewing apparatus which is particularly directed to the sewing of neckties. This apparatus uses a pair of intermeshing gears to corrugate a web by feeding the web through the intermeshing gears to provide the wavy pattern to the web. The web is then fed onto a needle and pulled down by a pair of pincher rollers which bunch up the web on the needle on the downstream side of the pincher rollers.

U.S. Pat. No. 2,695,652 shows a method of treating and corrugating a unit of strip material. The material is fed into a bath and then drawn along two endless chains having knobs thereon which intermesh. The knobs provide the web with an open wavy pattern which is maintained after the web leaves the nip area between the two chains and their intermeshing knobs.

U.S. Pat. No. 2,374,033 is a reference directed to a mechanism for making neckties also. This mechanism uses a pair of crimping bands which have intermeshing teeth which fold the corrugations of a web fed therebetween in order to crepe the material for a necktie lining.

U.S. Pat. No. 2,816,520 also shows a necktie sewing machine. This device uses a pair of parallel chains having angle crimpers and rod crimpers which mate to crepe the lining of a necktie. The lining is then fed on a needle through openings formed in the angle crimpers.

U.S. Pat. Nos. 2,871,807; 3,034,942; 3,516,116; 3,804,688; 3,922,129; 4,046,612; and 4,140,564 all disclose similar methods of corrugating or forming a waving pattern in a web by feeding the web through the nip of intermeshing teeth-like members either on gears or on a pair of parallel spaced belts.

U.S. Pat. No. 2,992,673 shows a apparatus for making cellular structures wherein pins are mounted on an endless conveyer in order to weave a pattern on a web fed therealong. The pins move into a position either above or below the web and then are moved vertically to the direction of the web to cause the web to be bent therebetween to form the internal portion of the cell structures.

U.S. Pat. No. 3,150,576 discloses feeding a web onto a moving irregular surface such that the web is blown against the surface to conform thereto. The web is then removed from the surface and maintains its structure in conformance with the moving surface on which it was laid.

U.S. Pat. No. 4,132,581 discloses an apparatus and method for forming plastic board. The apparatus includes the use of a corrugation forming station which forms a corrugated pattern to an internal piece of the plastic board. A toothed belt is synchronized with this corrugation forming station such that the teeth are received within the corrugations formed thereby.

In each of these devices, the corrugations are formed by a support which moves at a constant speed. Thus, the material must be fed onto the support and immediately takes its final shape usually by clamping the material on opposite sides by devices having the final corrugation pattern. These types of machines do not operate well with tight corrugations of webs, especially when tight corrugation in thicker resilient webs are desired. The devices are not available to make corrugations which have adjacent legs close or touching. Such high corrugation ratios have been left to apparatus which feed a web into a confined area where it is slowed, confined and caused to bunch up. The confines of the zone, however, limit the size of the corrugations.

SUMMARY OF THE INVENTION

The invention eliminates many of the limitations of the prior art by providing a method and an apparatus for corrugating a web quickly and uniformly while providing a large corrugation ratio. As used herein corrugation ratio is the ratio of a given length of the uncorrugated web to the length of corrugated web formed thereby.

The apparatus comprises a pair of endless drive chains which are each made up of a series of interengaged links. The chains are each driven on a pair of spaced gears providing an arcuate path along a portion of the chain's path and a straight path along an other portion of the chain's path.

The chains are spaced and parallel to one another. A plurality of paddles extend between the chains perpendicular to the chain path. The paddles are each mounted to one link of each chain in a manner that the paddle will extend perpendicularly outward from the link at all operable positions of the links. That is the paddle extends substantially outward as the chain travels along the arcuate portion of its path.

Means are provided for introducing the web onto the paddles at the paddle edges opposite the chain links. The means introduces the web onto the paddle edge at a point where the paddle and its link are traveling about the arcuate path portion. As the paddles travel to the straight path portion the paddle ends close together and travel more slowly thus folding the web portion extending between adjacent paddles.

In order to assure a proper fold a tucker wheel may be provided. The tucker wheel has protuberances which engage the web between the paddles and biases the web inward between adjacent paddles. This assures proper orientation of the web fold.

An endless belt may be provided to ride along the side of the web opposite the paddle ends. This holds the web in contact with the paddles to assure proper folding and prevents sticking of the web to the protuberances of the tucker wheel.

Further devices may be provided to improve the corrugated product prior to its leaving the apparatus.

The method comprises movably supporting a web of material at discrete spaced locations traveling at a given speed. The discrete locations are then moved toward one another by slowing a forward location and thereby permitting the next location to catch up. This closing of the locations causes the web to buckle between locations.

The web between the discrete locations may be biased to buckle in a preferred direction as discrete locations on either side of the buckle (corrugation) close upon one another. The support may be provided by mechanically supporting the web at the discrete locations or by providing a belt to support the entire web length. The belt would then have discrete spaced locations which are moved together buckling the belt to form corrugations in the web.

BRIEF DESCRIPTION OF THE DRAWINGS

The invention and the best mode of practicing the invention will now be described in detail with reference to the accompanying drawings wherein:

FIG. 7 is a partial side view showing paddle position at corrugation;

FIG. 8 is a view of a first of the paddles along lines 8—8 of FIG. 7;

FIG. 9 is a view of a second of the paddles along lines 9—9 of FIG. 7;

FIGS. 13–19 are partial perspective views of corrugation patterns created by the apparatus.

DETAILED DESCRIPTION

Figure 1:
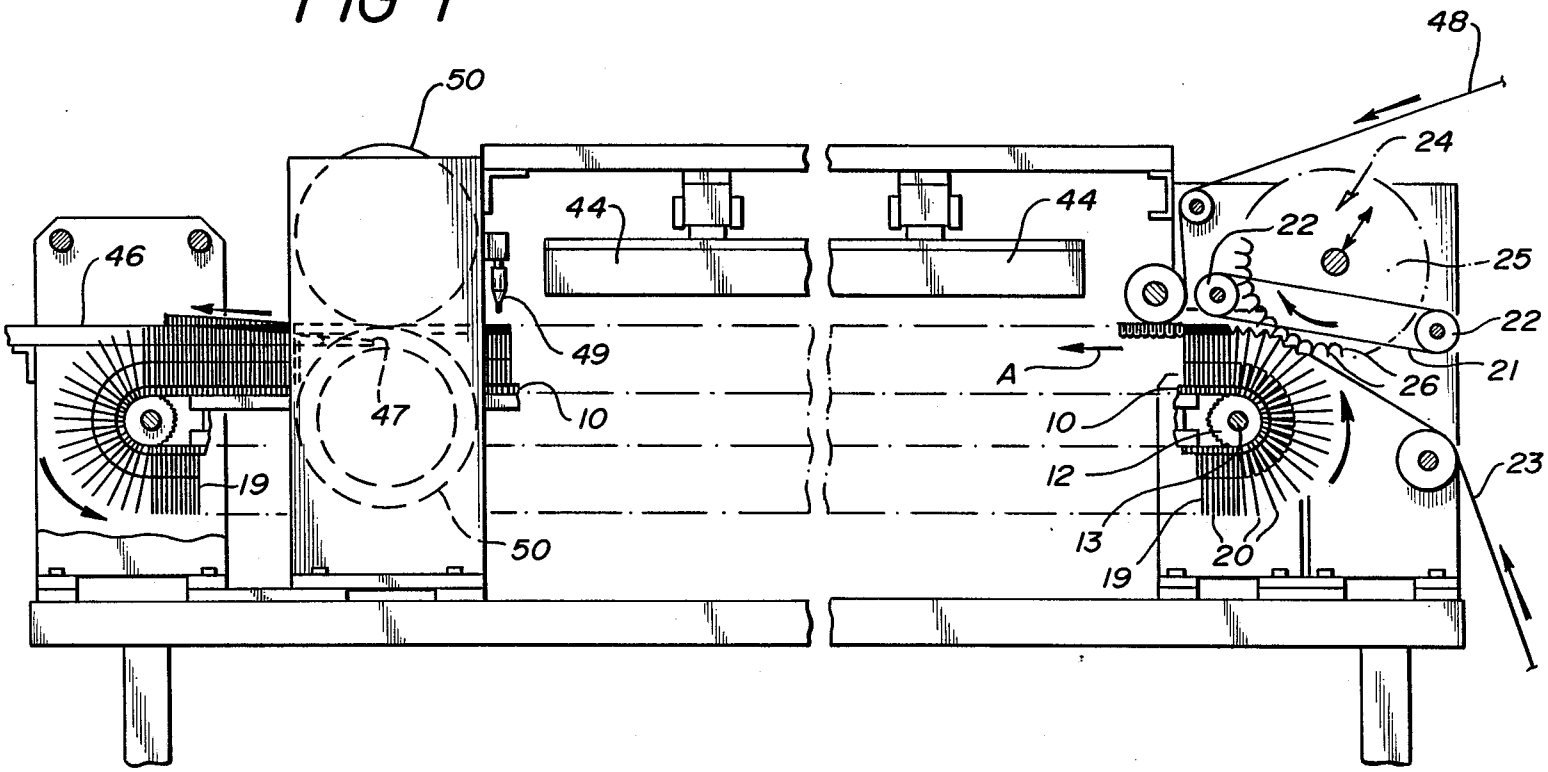
FIG. 1 is a schematic depiction of the apparatus of the present invention.
Figure 2:
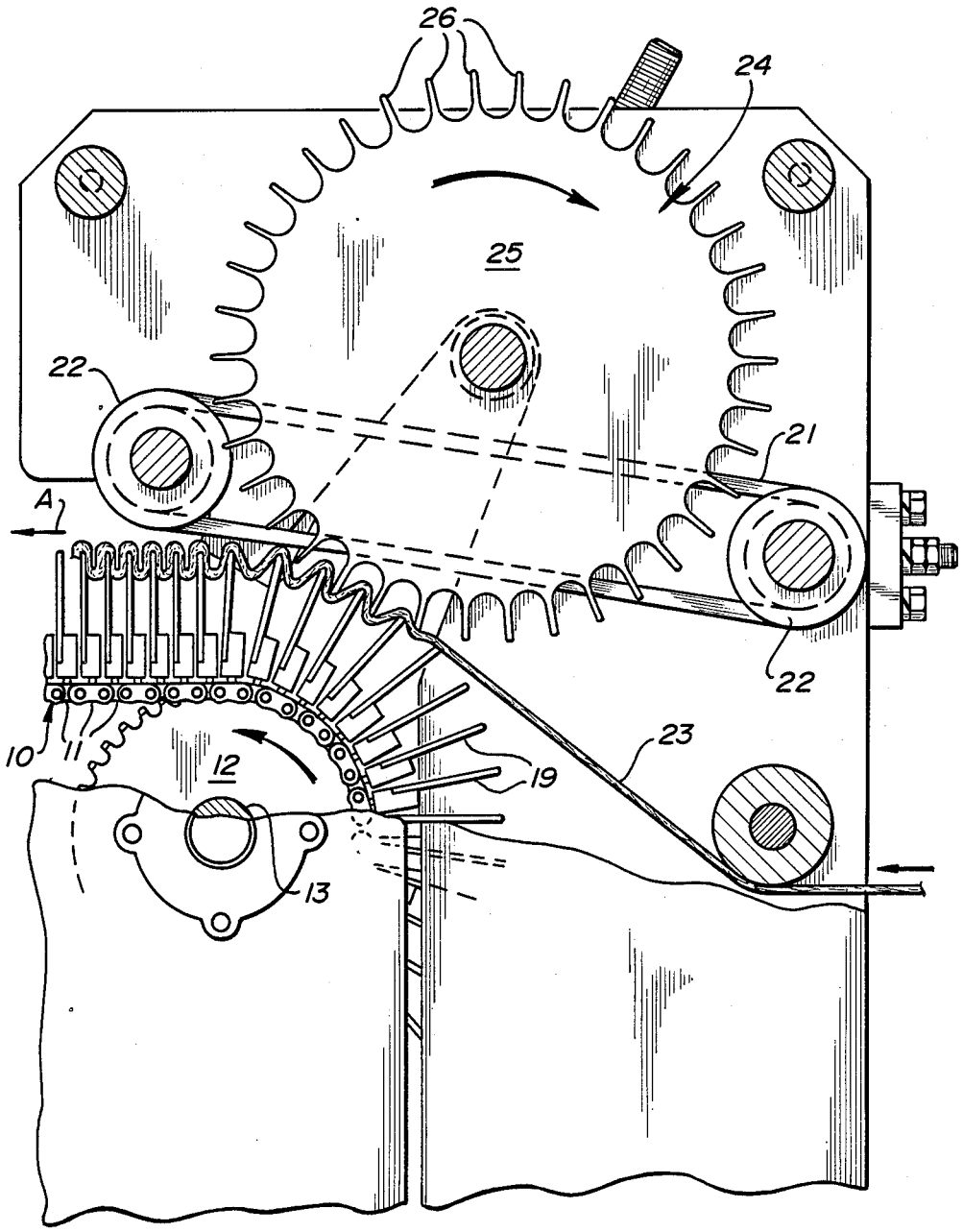
FIG. 2 is a partial side view showing in detail the interrelation of the parts at the introduction of a web.

Referring to FIG. 1, a schematic overview of the apparatus of the present invention is shown. At least one pair of endless chains 10 are positioned parallel to each other. Each chain 10 is made up of a series of interengaged links 11 (FIG. 2). The links 11 pivot with respect to adjacent links to permit chain flexibility.

The chains 10 are mounted to intermesh with and are driven by sprockets 12 (FIG. 2). The sprockets 12 may be fixed on the same shaft 13 thus assuring equal speed of motion in the chains 10 and proper registration. The chains 10 are driven by driving means such as an electric motor (not shown) driving shaft 13 in a known manner. Thus, the chains 10 are driven along a path in the direction of arrow A. The path is arcuate (i.e. semicircular) about sprockets 12 and substantially straight therebetween.

Figure 3:
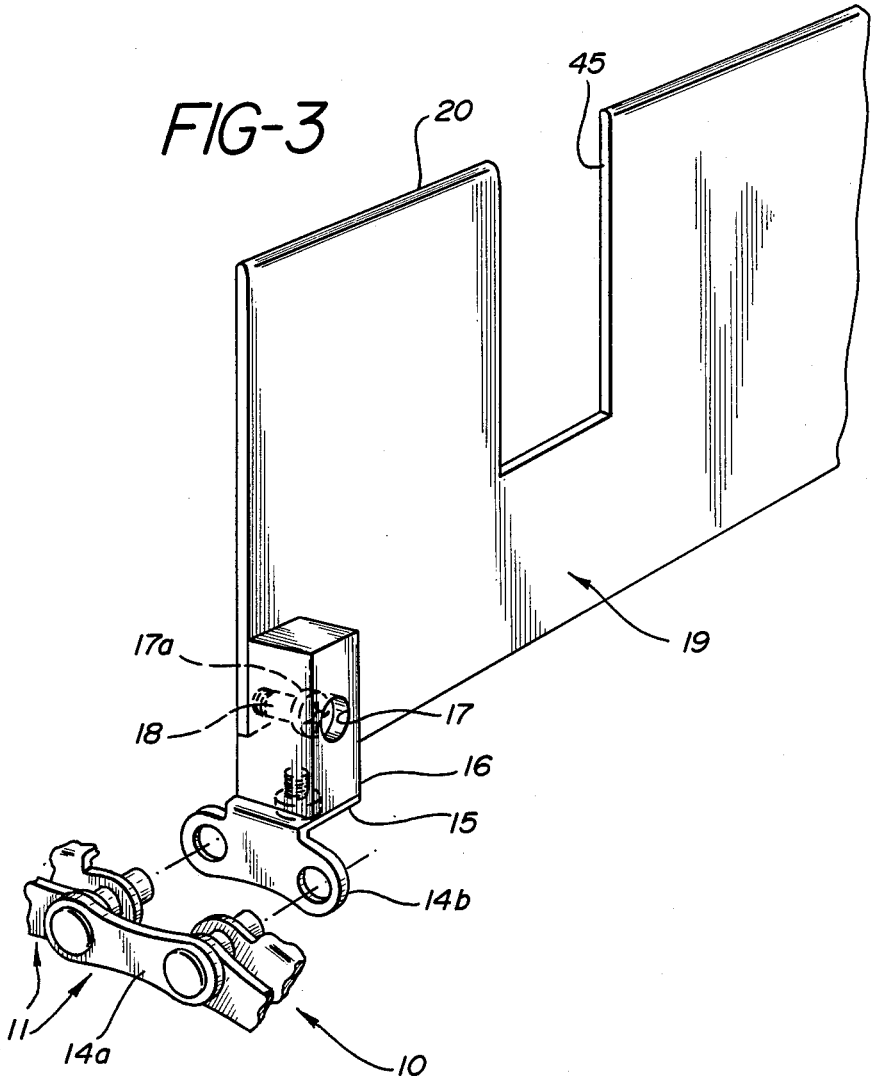
FIG. 3 is an exploded view of the connection between one of the paddles and the drive means of the apparatus.

Referring to FIG. 3, it is shown that the links 11 are made of two link members 14*a* and 14*b*. Link member 14*a* is substantially the same as those of known links. Link member 14*b*, however, is modified such that it has a perpendicularly angled extension 15. Link member 14*b* is mounted such that extension 15 is on link 11 at a radially outward position when link 11 travels about sprocket 12. The link 11 in this form is readily available from chain manufacturers and is referred to as a bent attachment for a roller chain.

Fixed to extension 15 is a mounting block 16 which extends radially outward from extension 15. Block 16 is fixed to extension 15 by any known manner such as adhesives, bolting, welding, rivetting or integrally forming the two parts. An alternative attachment will be disclosed below in connection with FIGS. 7 and 8.

The block 16 defines a bore 17 parallel to the link 11. This bore 17 has a stepped shoulder 17*a* and receives a bolt 18 which rests on shoulder 17*a* and threadedly secures the paddle 19 to block 16. In this manner paddle 19 is fixed in a position perpendicular to the longitudinal direction of link 11. Thus, the paddle will extend radially from the chain as link 11 passes around sprocket 12, moving its distal support end 20 in response to movement of link 11.

When link 11 passes around sprocket 12, the paddle 19 will fan out with respect to adjacent paddles. Thus, the support ends 20 will have a greater separation than they have when the links travel a straight line. The amount of the increase in separation of the support ends 20 is determined by the diameter of sprocket 12 and the radial length of the paddles 19. That is, the total distance from the axis of rotation of sprocket 12 to the support end 20.

In an alternate embodiment (FIG. 6) of the apparatus, the block 16 defines two parallel bores 17*b*. The bores are such that their axial direction is transverse to the direction of the chain paths and parallel to the longitudinal direction of link 11. Each bore 17*b* receives a pivot pin 33. At least one of the pins 33 in each of the mounting blocks 16 of the embodiment shown is free to rotate in its associate bore 17*b*.

Each pin 33 in block 16 either receives a fixed paddle 19 or a movable paddle 19*a*. The fixed paddle 19 is mounted at each end to a pivot pin 33 and held in a predetermined relation to mounting block is so it extends perpendicularly from the link 11. The fixed paddle 19 may be held by fixing the pivot pin 33 in bore 17*b* or by suitable restraining linkage. The movable paddle 19*a* is fixed to a pivot pin 33 which is free to rotate within the associated bore 17*b*. Each paddle 19, 19*a* is mounted in a similar fashion at its other transverse end to the other chain 10. Thus, the paddle 19, 19*a* extend transverse to and between the two drive chains 10 and extend perpendicularly outward from the chains 10.

Figure 6:
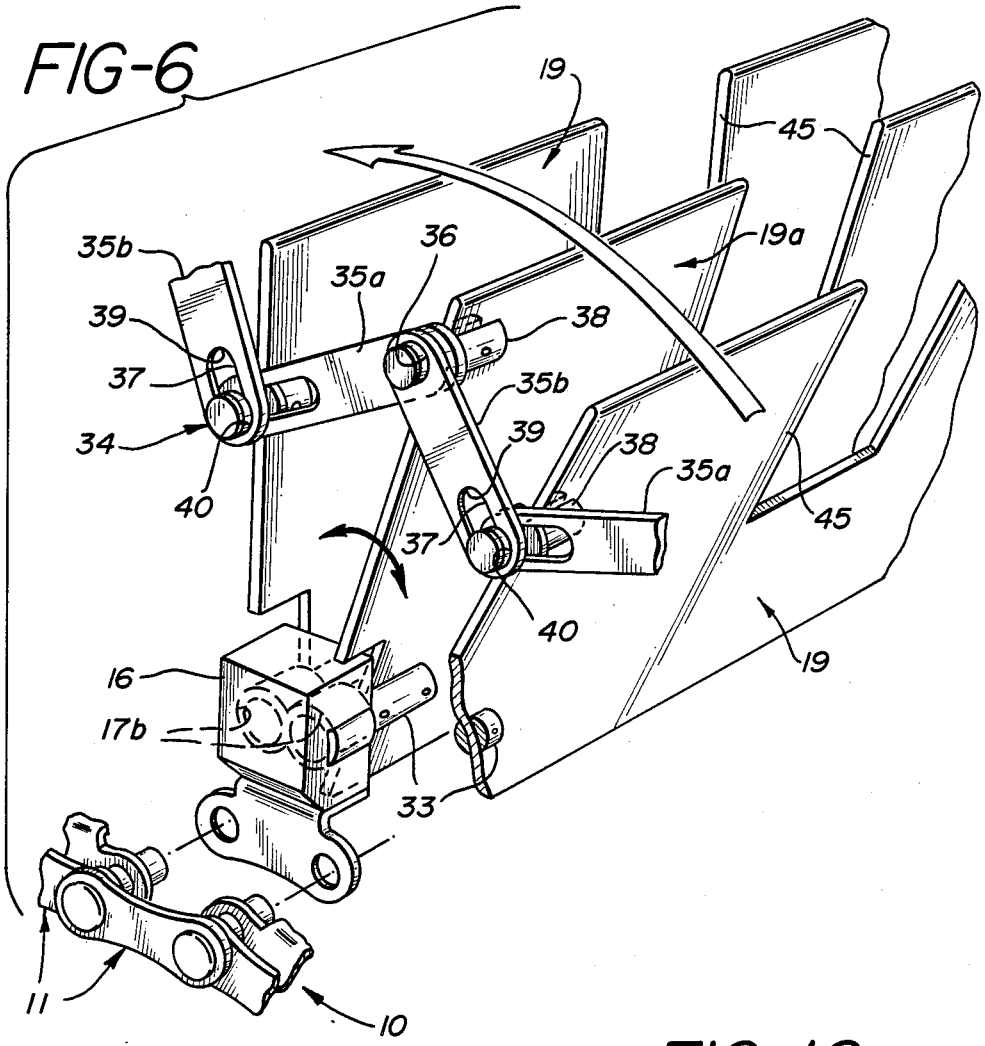
FIG. 6 is an alternate attachment of the paddles in an embodiment of the apparatus.

As shown in FIG. 6, the movable paddles 19*a* and the fixed paddles 19 of the alternative embodiment are interconnected by linkage 34. Linkage 34 is made up of a plurality of brackets 35*a*, 35*b*. The brackets 35*a*, 35*b* have an elongated shape with an opening 36 defined at a first end and a slot 37 defined at a second end. The slot 37 has its major dimension extending in the elongated direction of brackets 35*a*, 35*b*. Each paddle 19,19*a* has mounted thereupon a linkage pin 38. The linkage pins 38 of adjacent paddles 19,19*a* are offset along the height of the paddle. Each linkage pin 38 is received within either the slot 37 or opening of each of two brackets 35*a*, 35*b*. The other opening or slot in each bracket receives the linkage pin 38 of an adjacent paddle. The length and position of slot 37 is chosen so that the linkage pin 38 received therein is pressed against the inner end 39 of the slot 37 when the paddles connected by the bracket 35 are parallel; and the linkage pin 38 is at the outer end 40 of the slot 37 when the paddles 19,19*a* are fanned due to the chain passing about sprockets 12. By positioning adjacent linkage pins 38 in offset positions, the pin of each fixed paddle 19 is at the same position and the pin of each movable paddle 19*a* is the same position. Thus, identical brackets 35 used on all paddles 19,19*a* will cause the paddles to be equally spaced when fanned and when parallel.

It is therefore easily seen that a slight change in the length of brackets 35 to vary the separation of slot 37 and opening 36 so that alternating brackets differ in length of slot-opening separation will cause a variation in the paddle separation. In such a design movable paddles 19*a* may be held at a closer distance to the fixed paddle 19 in front of it than the fixed paddle 19 behind it or vice versa. The difference in separation is amplified when the paddles are in the fanned position thus permitting corrugations of alternating sizes as described below. It must also be understood that linkage 34 and movable paddles 19*a* may be omitted entirely leaving fixed paddles 19. This would produce a device having fewer paddles along the length of the chain, thus producing fewer but deeper corrugations.

Figure 4:
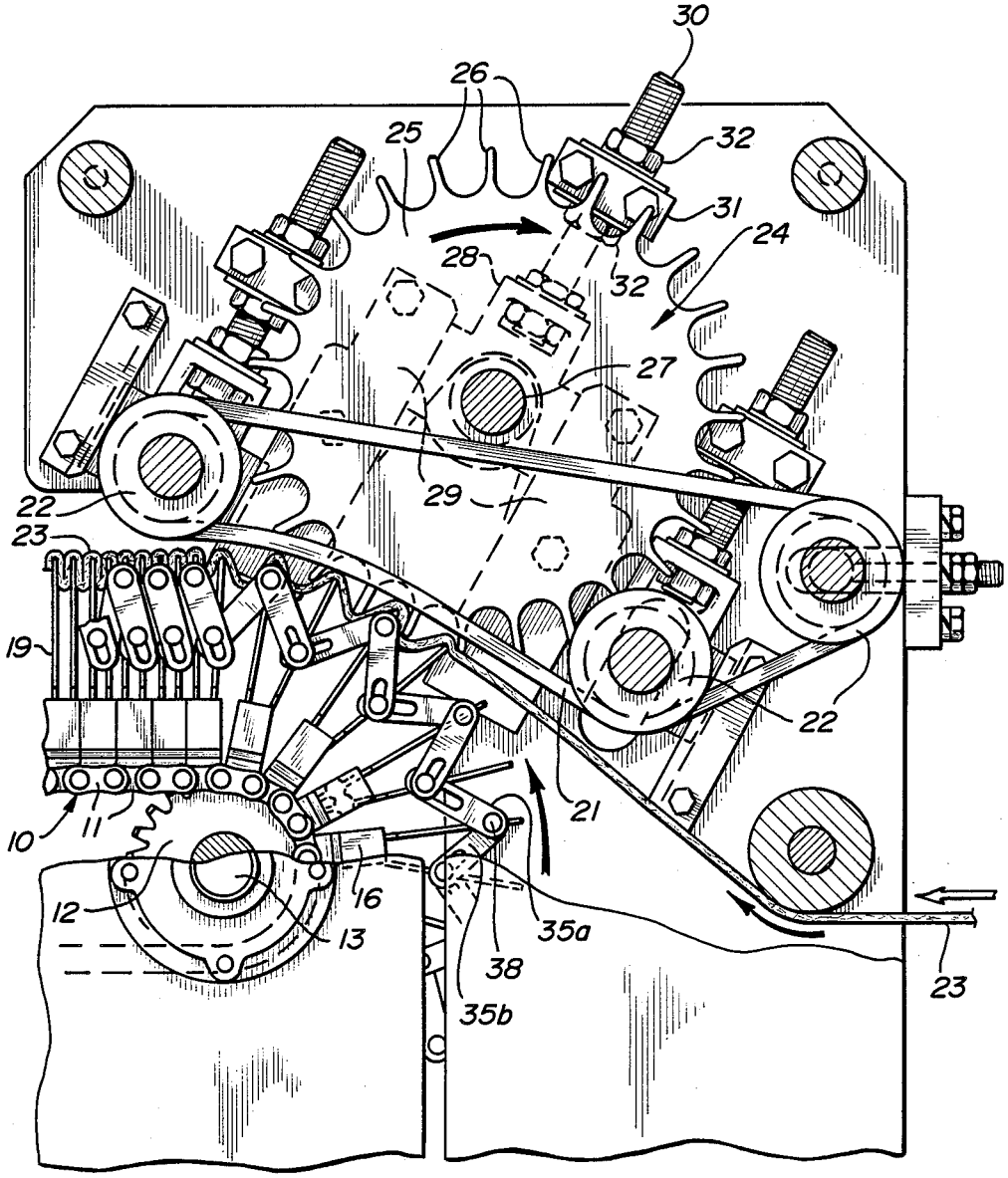
FIG. 4 is a partial side view of the introduction end of the apparatus.

Adjacent the support end 20 of the paddle 19 is a series of hold-down belts 21 (FIG. 4). The hold-down belts are driven about pulleys 22. Thus, the web 23 to be corrugated is fed in between belts 21 and support end 20 and sandwiched therebetween. The web 23 need not be gripped tightly, rather the belts 21 merely prevent the web 23 from bowing out away from the paddles. When using a very flexible, nonresilient web, the belts 21 often may be omitted completely.

In order to assure that the web 23 bends in between the support ends 20 of paddle 19 to form a corrugation, a tucker 24 is provided (FIG. 2). The tucker may be in the form of a wheel 25 having protuberances 26 extending radially therefrom. The wheel 25 is synchronized to the paddle 19 so a protuberance 26 is received between two adjacent paddles as the paddles close to create a corrugation. The protuberance 26 is removed as the paddles move to their fully closed position. At this point, hold-down belts 21 prevent protuberance 26 from pulling the web 23 out from between the paddles.

An adjustment of the length or radial position of protuberances 26 can change the characteristics of the corrugated web. By making the protuberances longer or repositioning the wheel 25 closer to the paddles the protuberances will contact the web earlier. The protuberances would then pull more of the web in before the second paddle rose to support the web. In this manner a longer portion of web is extending between the adjacent paddles thus making a deeper corrugation.

The wheel 25 may be made adjustable by an apparatus such as that shown in FIG. 4. A shaft 27 on which wheel 25 rides is supported in a journal 28. The journal 28 is slidable along mounts 29 attached to the machine frame. A threaded member 30 extends from journal 28 through cleat 31 which is also attached to the machine frame. Threaded member 30 is held in cleat 31 by nuts 32. By adjusting nuts 32, the position of threaded member 30 relative the cleat 31 and therefore relative the mounts 29 may be adjusted. The change in position of threaded member 30 moves journal 28 along mounts 29 adjusting the shaft 27 and wheel 25 riding thereon.

Figure 11:
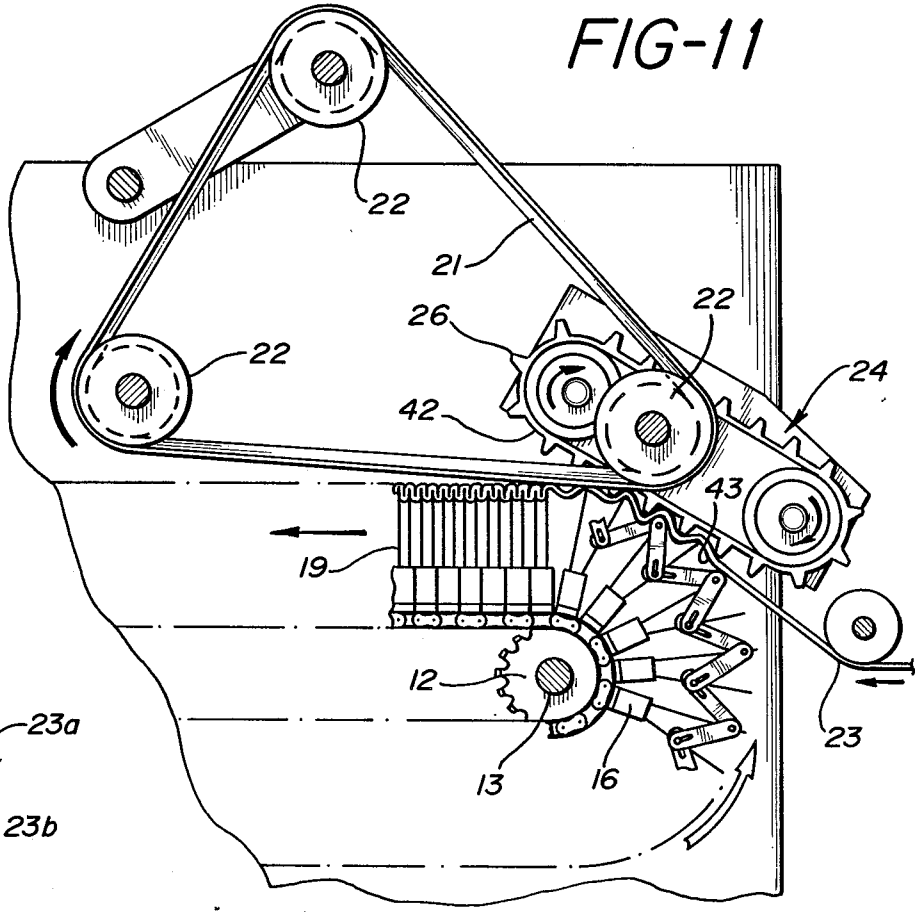
FIG. 11 is a partial side view of an alternate embodiment of the tucker.
Figure 10:
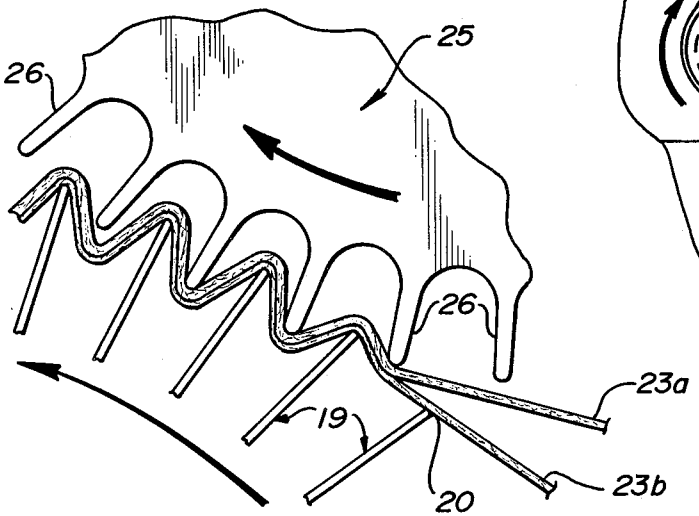
FIG. 10 is an enlarged view of the tucking operation.

FIG. 10 shows in greater detail the effect of the tucker wheel 25. In this depiction the protuberances are longer than necessary to merely initiate the folding. Therefore, the protuberances pull in an excess amount of web and hold it in position well into the folding step. This enhances operation of the device when a stiffer web is used or when a web composite of webs 23*a*, 23*b* is used. This is particularly suited for holding and folding a web composite when the webs have different stiffnesses or resiliencies. An alternative embodiment of the tucker is shown n FIG. 11. There a belt 42 moves adjacent the support ends 20. Protuberances 26 extend radially therefrom. As is shown, web 23 forms a V-shape at point 43. However, at point 43 the support ends 20 have not yet begun to close together. Therefore, the corrugations as shown in FIG. 11 are deeper than if web 23 was fed in flat and tucked between the paddles as the paddles began to close.

Figure 12:
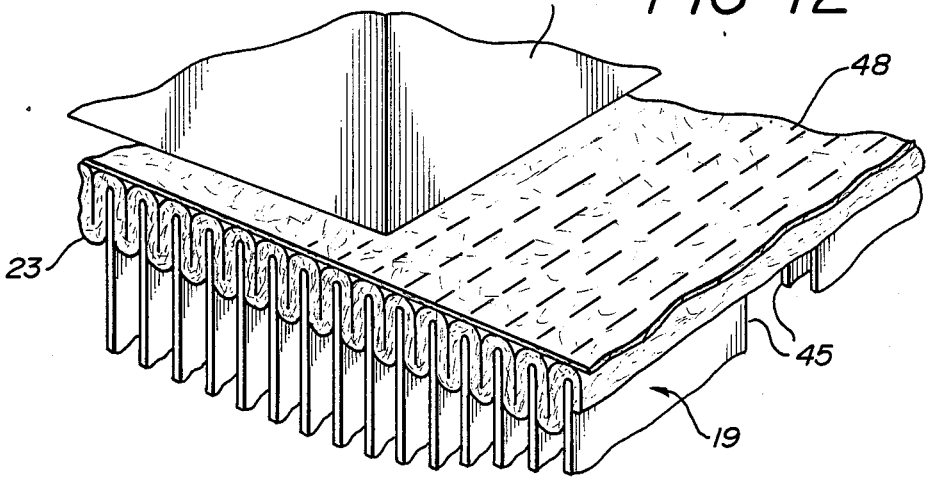
FIG. 12 is a partial perspective view of the oven of the apparatus.

After the paddles have closed to form the corrugations a number of further fabricating steps may take place to improve or stabilize the corrugation. For example, an oven 44 (FIG. 12) may be positioned adjacent the web laden paddles. By using an at least partially thermoplastic web, the oven would partially melt the web causing adjacent corrugations to adhere upon cooling. This stabilizes the corrugated web for ease of handling upon removal from the apparatus by preventing separation of adjacent corrugations.

Additional steps may be taken such as adding particulate matter to the corrugated web as the paddles are closing. Passing the web beneath the oven then adheres the tops of adjacent corrugations and compartmentalizes the particulate matter within the corrugation.

Figure 5:
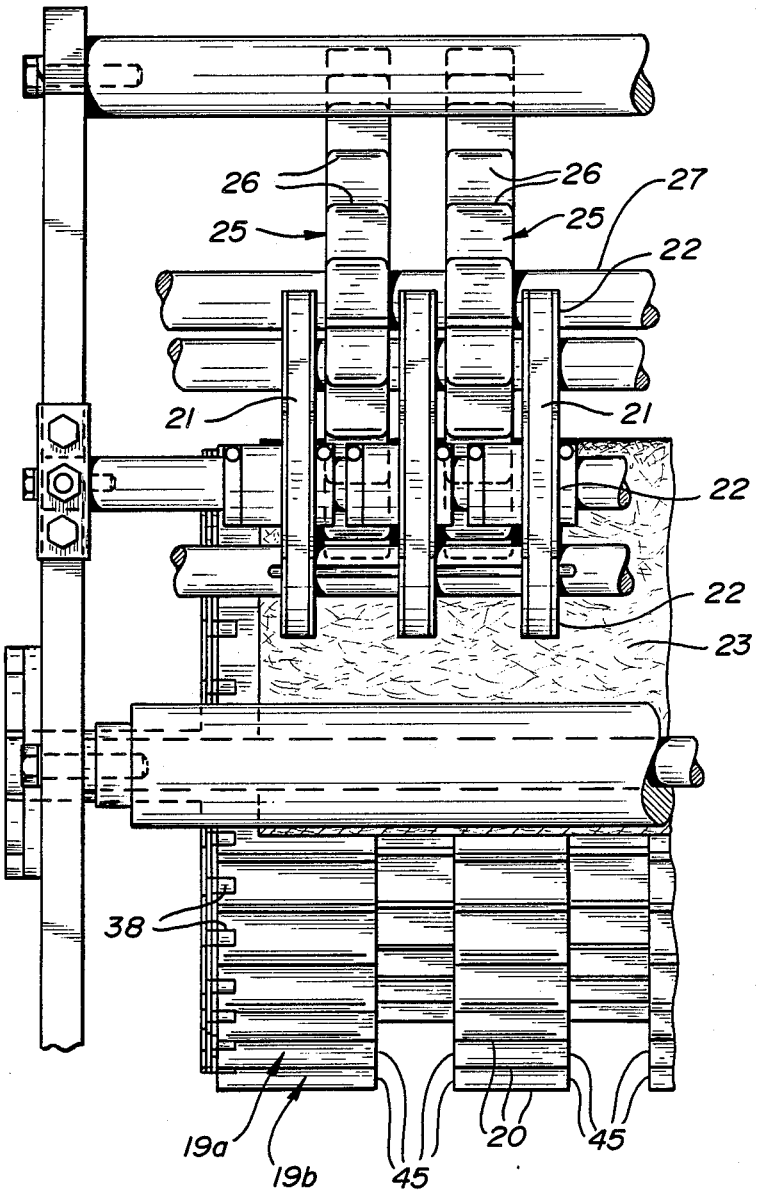
FIG. 5 is a partial end view of the introduction end of the apparatus.

In order to remove the corrugated web from the apparatus, a plurality of slots 45 (FIG. 5) are formed at the support end 20 of the paddles 19,19*a*. The slots 45 in all the paddles are aligned so as to define a channel when the paddles are parallel. Each channel so defined receives a wedge shaped skid 46. The skid 46 is preferably made of a low friction substance so the corrugated web slides easily thereon. The tip 47 is below the deepest penetration of web 23 between the adjacent paddles. Thus, the skid scoops the corrugated web up and pushes it out from between the paddles without separating the paddles. This permits the corrugations to be removed intact whereas separating the paddles may pull the corrugation tops apart tearing the bond therebetween.

The preferred embodiment for ease of maintenance is shown in FIGS. 7–9 and has two pairs of spaced chains. Each pair of chains holds an alternate paddle in the series. The sprockets of one pair of chains are offset from the sprockets of the other pair by ½ pitch, that is ½ a chain link length.

The paddles 119 and 119*a* have flanges 120 formed at their sides. Each of these flanges 120 defines a pair of openings 121. The drive chains 110 have mounting arms 122 extending from each link. These arms 122 each define a pair of openings 123 which match with openings 121. The openings 121,123 receive a rivet 124 which secures each paddle 119,119*a* to one of each of its drive chains 110.

The flanges 120 of paddle 119*a* are formed intermediate the transverse ends of the paddle 119*a*. In this manner the drive chains of paddle 119*a* are positioned in spaced relation within a central portion. The paddle 119*a* tapers in shape upward from the flanges to widen and form the support edge of full width.

The flanges 120 of paddle 119 are formed near the transverse ends of paddle 119. In this manner the drive chains 110 of paddle 119 are positioned at the outer edge of paddle 119. The paddle 119 forms a central open portion defined by edge 125.

When paddles 119,119*a* are interleaved, the drive chains of paddle 119 do not interfere with the paddles 119*a* because the chains pass through the space left open by the tapered shape of paddle 119*a*. Furthermore, the chains of paddle 119*a* do not interfere with the operation of paddle 119 as the chains pass through the central open portion of paddle 119. Thus, a quick sturdy interleaved system of half the pitch of its chains is created by interleaving two sets of paddles attached to separate pairs of chains.

In operation, the two pairs of endless chains are driven at the same speed and synchronized so that the paddles extend transversely to the path of the chains. As the chains travel about the sprockets, the paddles fan out and open up. Then as the chains straighten out to travel the straight path, the paddles close back together as described above. The web 23 is fed onto the ends of the paddles 19 and 19*a* tangentially to the arc they form when fanned. Thus, the web is placed on the tips of the paddles when they are in their fanned position. The spacing of the paddle ends is the largest factor in the size of the corrugations. For example, if the paddles fan to a separation of six inches and close to a separation of one-half inch, then a corrugation ratio of twelve is obtained and each corrugation will be approximately three inches deep. By tucking, however, the corrugation ratio may be increased. For example, if the material of the web is tucked in one inch while the paddles are spread six inches, a corrugation ratio of approximately 12.65 is obtained when the paddles close to one half inch.

As mentioned above, the linkage on the paddles of the alternative embodiment may be changed so the movable paddles fan closer to a fixed paddle on one side than to a fixed paddle on the opposite side of the movable paddle. In this manner, a corrugation pattern is produced where adjacent corrugations are of different depth permitting alternation of corrugation size.

As the web 23 is fed onto the ends of the paddles, tucker wheel 25 starts the fold of the web radially inward toward the chain between the support ends 20 of the paddles. This is done by the alignment of protuberances 26 to fall in between the paddles. As the paddles ride up to their straightened position, belt 21 holds the web to prevent it from bowing out from in between the paddles. As the chain straightens out, the paddles are drawn together to a parallel position. Thus, the web is folded into a corrugated condition wherein the legs of adjacent corrugations are in contact with each other. At this point, an optional cover layer 48 is introduced onto the tops of the corrugations. The paddles then travel beneath oven 44 which heats the web material and cover layer causing the corrugations to fuse to the cover layer. This stabilizes the corrugated web. The web thus stabilized is passed through hot air supplies 49 which soften the marginal portions. In order to remove the web from the paddles, skids 46 which fit in slots 45 extend beneath the corrugated web. The forward motion of the paddles pushes the web along the inclined upper surfaces of the skids to lift the web from between the paddles and out of the apparatus for further processing. As the web is being removed, the softened marginal portions are compressed by embossing rolls 50 to form a unitary selvedge. This adheres the edges and prevents separation of the corrugations.

Figure 17:
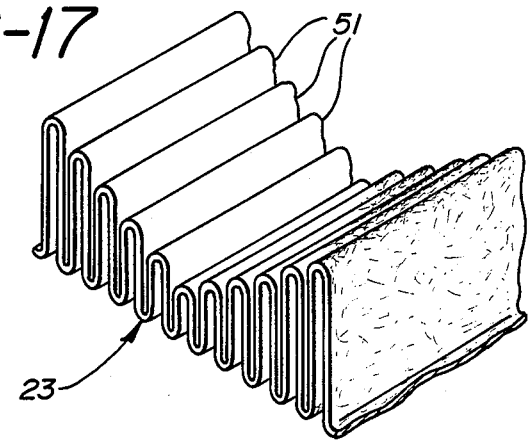
Figure 18:
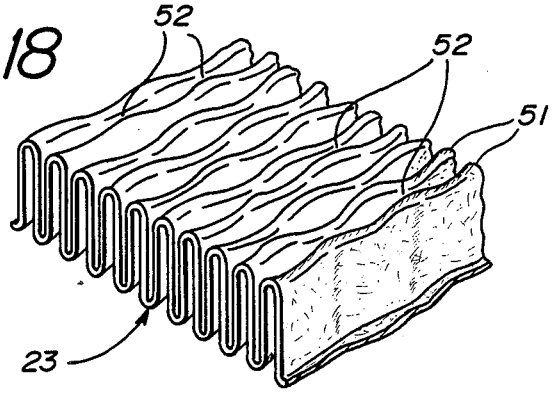
Figure 19:
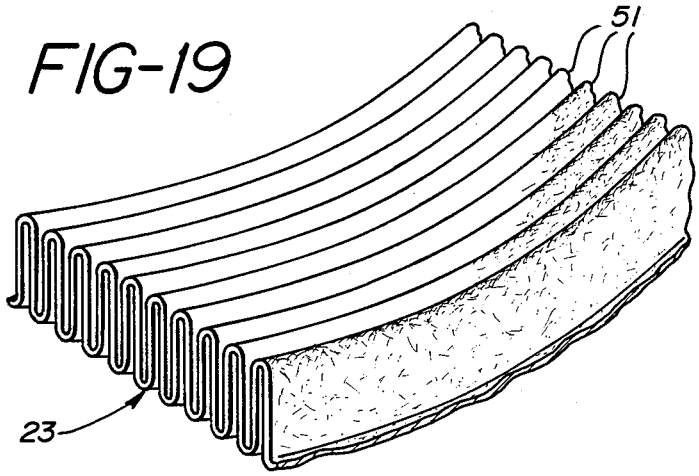

Thus it is seen that a high quality web of controlled construction—that is controlled size of corrugation ratio and shape may be easily and efficiently produced. Referring now to FIGS. 13–19, novel corrugation constructions which may be fabricated by the present apparatus are shown. FIG. 13 shows a corrugated web having uniformly sized corrugations 51. This structure is formed by having equally spaced straight paddles and equal length protuberances on the tucker. FIG. 14 shows a construction formed having paddles of changing pitch. Such a variation is produced by removing three floating paddles in a row thus leaving the interleaved fixed paddles. The pitch of the paddles without the floating paddles is twice the remaining paddles and form corrugations 51*a*. The closely spaced remaining paddles produce the closely spaced corrugations 51*b*. To provide uniform height, the protuberances of the tucker must be adjusted and synchronized to pull more material between the close paddles to get uniform height of corrugation. FIG. 15 shows an arrangement similar to FIG. 14, however, the protuberances of the tucker are longer in the narrow separated paddles thus pulling in more material and making the narrow corrugations taller. FIG. 16 shows a corrugated web formed using a constant paddle pitch with the tucker of FIG. 15. Thus, a constant corrugation thickness is obtained with a varying corrugation height. FIG. 17 shows a construction formed using a tucker wheel that has smoothly varying protuberance length. As the protuberances shorten, the corrugations become shallower. Then as the protuberances lengthen, the corrugations become deeper. FIGS. 18 and 19 show corrugation patterns obtained by shaping the paddles. A wavey edge on the paddle produces the pattern of FIG. 18. If adjacent paddles are made to meet at wave peaks, it may be possible to bond adjacent corrugations 51 at the points 51 where the patterns meet. FIG. 19 shows the corrugation pattern created by slightly bowed paddles.

Further modifications to the apparatus can be made without deviating from the spirit of the invention claimed herein as evidenced by the appended claims.

What is claimed is:

1. An apparatus for corrugating a web made of at least partially heat softenable fibers, said web having a length and transverse width, as said web moves in a direction parallel to said length, comprising:

(a) at least one first support means comprising a first paddle having an edge which extends transverse to the direction of movement of said web, to movably support said web at a first location;

(b) at least one second support means comprising a second paddle having an edge, which extends transverse to the direction of movement of said web, to movably support said web at a second location spaced longitudinally along said web from said first location;

(c) a first endless drive means having said first paddle fixed thereto to extend radially outward therefrom, a second endless drive means having said second paddle fixed thereto to extend radially outward therefrom, said drive means movable in a direction parallel to the direction of movement of said web along a path which is arcuate along first portion and substantially straight along a second portion such that said web is supported at said first and second locations by said first and second paddles and the separation between said first and second locations is closed to fold a web portion extending therebetween as said first and second paddles move to said second portion of said path; and (d) heating means to heat said web after said separation has been closed to soften and bond fibers of adjacent folds of the web together prior to removal of said corrugated web from said paddles.

2. An apparatus according to claim 1 wherein:
(a) said endless drive means comprises a pair of spaced parallel synchronized chains and said at least one paddle is fixed thereto for movement therewith.

3. An apparatus according to claim 2 wherein:
(a) said second paddle is mounted between said parallel chains for rotation about an axis perpendicular to the path of travel of said chains.

4. An apparatus according to claim 3 further comprising:
(a) each of said first and second paddles having at least one lateral edge extending away from said chains; and
(b) linkage means attached to said lateral edge, spaced outwardly from said chains and extending between said first and second paddle for holding said second paddle in a first position parallel to said first paddle as said first and second paddle travel along the straight portion of the chain path and in a second position extending radially outward from said chain as said first and second paddles travel along the arcuate portion of said chain path.

5. An apparatus according to claim 1 wherein:
(a) said endless drive means comprises two pairs of spaced parallel synchronized chains, said at least one paddle is fixed to one of said pairs of chains for movement therewith and the other of said first and second paddles is fixed to the other of said pairs of chains for movement therewith.

6. An apparatus according to claim 5 wherein:
(a) said two pairs of chains have equal pitch.

7. An apparatus according to claim 6 wherein:
(a) said two pairs of chains are each offset from the other in the longitudinal direction by one half pitch length.

8. An apparatus according to claim 7 wherein:
(a) said first and second paddles are equally spaced from adjacent paddles.

9. An apparatus according to claim 7 wherein:
(a) said first and second paddles are unequally spaced from adjacent paddles.

10. An apparatus according to any one of the claims 1, 2, 4, 5, 7, 8 or 9 further comprising:
(a) tucker means for biasing the portion of the web extending between said first and second locations in a direction away from a line extending between said first and second locations.

11. An apparatus according to claim 10 further comprising:
(a) at least one hold down belt on a side of said web opposite said first and second support means to hold said web on said first and second support means at said first and second locations.

12. An apparatus according to claim 1 further comprising:
(a) removal means for removing said web from said first and second support means after said closing means has closed the separation between said first and second support means.

13. An apparatus according to claim 12 wherein:
(a) said removal means comprises at least one skid having an upper surface at least partially below said first and second support means which angles upward above said first and second support means to provide a surface to support said web and lift said web from said first and second support means.

14. An apparatus for corrugating a web comprising:
(a) at least two pairs of spaced, parallel endless drive chains comprising a series of interengaged links;
(b) at least two pairs of spaced gears for receiving said drive chains to define a drive chain path for each drive chain which is arcuate about said gears and substantially straight and coplanar therebetween;
(c) a plurality of paddles extending radially from said drive chains with each paddle attached rigidly to one link on each drive chain of said pair of chains to hold the paddle with a support edge transverse to the drive chain path and substantially perpendicular to the drive chains;
(d) means for driving said drive chains along said drive chain path;
(e) a set of pincher rollers to introduce the web onto the paddles at a point where the paddles are fanned out by arcuate passage of said chains about said gears;
(f) an endless belt positioned at the support edges of the paddles to hold the web in contact with the paddles as the paddles close together to travel along the straight portion of said chain path;
(g) at least one adjustable tucker wheel mounted for rotation adjacent said paddles at about the point said web is introduced onto said paddles while said paddles are fanned;
(h) protuberances extending radially from said tucker wheel to tuck the web in between two adjacent paddles while said paddles are in their fanned position;
(i) an oven mounted along said straight portion of said path to heat said web as it passes therethrough to partially melt said web and adhere adjacent corrugations together upon cooling and prior to removing said corrugated web from said paddles;
(j) at least one skid having a surface to engage and support the corrugated web and to provide a sliding path for said web angled to remove said web from the paddles.

* * * * *